US012490837B2

(12) United States Patent
Duhamel et al.

(10) Patent No.: US 12,490,837 B2
(45) Date of Patent: Dec. 9, 2025

(54) MODULAR MULTI-ZONE MATTRESS AND RELATED DESIGN METHOD FOR OPTIMIZATION OF A SLEEP SURFACE

(71) Applicant: Eric Duhamel, Montréal (CA)

(72) Inventors: Eric Duhamel, Montreal (CA); Eric Wagnac, Laval (CA); Elisabeth Laroche, Montreal (CA)

(73) Assignee: Eric Duhamel, Montreal (CA)

( * ) Notice: Subject to any disclaimer, the term of this patent is extended or adjusted under 35 U.S.C. 154(b) by 497 days.

(21) Appl. No.: 17/905,500

(22) PCT Filed: Oct. 19, 2021

(86) PCT No.: PCT/CA2021/051468
§ 371 (c)(1),
(2) Date: Sep. 1, 2022

(87) PCT Pub. No.: WO2022/082303
PCT Pub. Date: Apr. 28, 2022

(65) Prior Publication Data

US 2023/0124824 A1 Apr. 20, 2023

Related U.S. Application Data

(60) Provisional application No. 63/093,403, filed on Oct. 19, 2020.

(51) Int. Cl.
*A47C 27/14* (2006.01)
*A47C 31/12* (2006.01)

(52) U.S. Cl.
CPC ..... *A47C 27/148* (2013.01); *A47C 31/123* (2013.01)

(58) Field of Classification Search
CPC ..... A47C 27/148; A47C 31/123; A47C 27/15
See application file for complete search history.

(56) References Cited

U.S. PATENT DOCUMENTS 5,231,717 A * 8/1993 Scott ..... A47C 31/123 5/400
6,115,861 A 9/2000 Reeder
(Continued)

FOREIGN PATENT DOCUMENTS

CN 104799614 A 7/2015
CN 207969931 U 10/2018
(Continued)

OTHER PUBLICATIONS

ISA/CA, International Search Report for PCT/CA2021/051468, Jan. 25, 2022, 5 pages.
(Continued)

*Primary Examiner* — Eric J Kurilla
(74) *Attorney, Agent, or Firm* — Innovation Law Office; Dennis S. Schell

(57) ABSTRACT

A modular multi-zone mattress and related method of design for which a plurality of mattress modules are adjoined to define a sleep surface having a variable deformability. A number of the mattress modules and a deformability of each mattress module are tailored to a unique body shape and weight distribution of a mattress user to provide at least one of an optimized body posture and an optimized contact pressure distribution over the sleep surface. Pressure factors include a weight and a morphologic profile of the mattress user, and optionally, a sleep position of the mattress user.

20 Claims, 11 Drawing Sheets

(56) References Cited

U.S. PATENT DOCUMENTS

| | | | | |
|---|---|---|---|---|
| 8,117,700 | B2 * | 2/2012 | Howard | G06Q 30/0621 5/690 |
| 9,179,781 | B2 * | 11/2015 | Melsen | A47C 27/148 |
| 2008/0097779 | A1 * | 4/2008 | Rawls-Meehan | A47C 7/027 705/304 |
| 2017/0325596 | A1 * | 11/2017 | Torbet | A47C 27/14 |

FOREIGN PATENT DOCUMENTS

| | | | | |
|---|---|---|---|---|
| DE | 202006001350 | U1 * | 5/2006 | A47C 27/148 |
| KR | 101833771 | B1 | 3/2018 | |
| WO | 2012160508 | A1 | 11/2012 | |

OTHER PUBLICATIONS

Caussa, "Automatic RBG-depth-pressure anthropometric analysis and individualised sleep solution prescription", Journal of Medical Engineering & Technology, Jul. 21, 2017, pp. 486-497, vol. 41, No. 6, Taylor & Francis Group, London, England.

Lahm, "Physiologic responses during rest on a sleep system at varied degrees of firmness in a normal population", Ergonomics, Nov. 9, 2010, pp. 798-815, vol. 45, No. 11, Taylor & Francis Group, London, England.

Pearson, "Comfort and its measurement—a literature review", Disability and Rehabilitation: Assistive Technology, Sep. 9, 2009, pp. 301-310, vol. 4, No. 5, Taylor & Francis Group, London, England.

Tonetti, "Effects of different mattresses on sleep quality in healthy subjects: an actigraphic study", Biological Rhythm Research, Feb. 9, 2010, pp. 89-97, vol. 42, No. 2, Taylor & Francis Group, London, England.

Verhaert, "Ergonomics in bed design: the effect of spinal alignment on sleep parameters", Ergonomics, Feb. 2, 2011, pp. 169-178, vol. 54, No. 2, Taylor & Francis Group, London, England.

ISA/CA, Written Opinion of the International Searching Authority for PCT/CA2021/051468, Jan. 25, 2022, 7 pages.

* cited by examiner

Example of a male morphology (85kg)

Example of a female morphology (66kg)

MODULAR MULTI-ZONE MATTRESS AND RELATED DESIGN METHOD FOR OPTIMIZATION OF A SLEEP SURFACE

TECHNICAL FIELD

The present invention generally relates to mattresses, and more particularly to a modular multi-zone mattress and related techniques for designing said mattress with an optimized sleep surface of variable deformability.

BACKGROUND

Some ways of improving the quality of sleep include providing a modular mattress. Modular mattresses can include several modules of mattress material that can be assembled to form a sleep surface.

Existing modular mattresses are designed based on general anthropometric knowledge including known morphotypes, such as ectomorph or mesomorph. These modular mattresses therefore lack flexibility and precision to adapt the sleep surface to one mattress user specifically.

There is thus a need for a modular mattress that overcomes at least some of the drawbacks of what is known in the field.

SUMMARY

The techniques described herein relate to the design and assembly of a modular multi-zone mattress having an optimized sleep surface defined by multiple mattress modules. Implementations of the modular multi-zone mattress respond to the above-identified need by providing each mattress module with a deformability and a geometry that are tailored to the individual anthropometry of each mattress user, including at least one of the body weight distribution and a body posture. The resulting sleep surface provides to the mattress user an optimized contact pressure distribution for a given body posture.

The present modular multi-zone mattress comprises a plurality of mattress modules being longitudinally and optionally laterally adjoined to define a sleep surface having a variable deformability, wherein a number of the mattress modules and a deformability of each mattress module are tailored to a unique body shape and weight distribution of a mattress user, thereby providing at least one of an optimized body posture and contact pressure distribution over the sleep surface. The variation in the body posture and in the contact pressure distribution when in contact with the sleep surface can be the result of the combination of several pressure factors of the mattress user and the deformability profile of the sleep surface. The pressure factors include a weight and a morphologic profile of the mattress user. Optionally, the pressure factors can further include a sleep position of the mattress user.

In one aspect, there is provided a modular multi-zone mattress having an optimized sleep surface. The modular multi-zone mattress includes a plurality of mattress modules being adjoined to have a top surface thereof defining the optimized sleep surface. The optimized sleep surface has a variable deformability that provides at least one of an optimized body pressure response distribution and a minimized body posture variation (also referred to as optimized body posture), wherein a number of the mattress modules is selected in accordance with slope variations in a morphological profile of a mattress user, and wherein a deformability of each mattress module is tailored to a body weight distribution of the mattress user, for a given body posture.

In some embodiments, the multiple mattress modules are juxtaposed longitudinally to form the sleep surface. In addition, a length of the top surface of each mattress module can be chosen in accordance with slope variations in a longitudinal morphological profile of the mattress user.

For example, the mattress can include at least three mattress modules for supporting respectively a head portion, an upper body portion and a lower body portion of the mattress user. Alternatively, the mattress can include at least five mattress modules for supporting respectively a head portion, a shoulder portion, a back portion, a bottom portion and a leg portion of the mattress user.

In some embodiments, the number of the mattress modules can be in accordance with a number of inflection points encountered in a curvature of the morphological profile. In addition, the number of mattress modules can be in accordance with a number of slope variations $\Delta S$ in the morphological profile having a threshold value.

In some embodiments, the multiple mattress modules comprise at least one end mattress module which dimensions are chosen to meet mattress standard size specifications. For example, the multiple mattress modules can include two end mattress modules.

In some embodiments, each mattress module can be of parallelepipedal shape having the top surface, a bottom surface, two opposed longitudinal sides and two opposed transverse sides. Optionally, at least one mattress module can have the length of the top surface differs from the length of the bottom surface. Further optionally, at least one of the two opposed transverse sides of at least one mattress module can be tapered at an angle from the top surface to the bottom surface. For example, both of the two opposed transverse sides of at least one mattress module can be tapered at an angle from the top surface to the bottom surface. For example, the angle of tapering of one opposed transverse side can be the same or different from the other opposed transverse side. Further optionally, at least one of the two opposed transverse sides of at least one mattress module can be inwardly or outwardly arched from the top surface to the bottom surface.

In some embodiments, the top surface of at least one mattress module can be upwardly or downwardly arched in accordance with the morphological profile of the mattress user in at least one of the longitudinal direction and the transverse direction.

In some embodiments, the mattress can further include a frame structure surrounding the plurality of mattress modules to provide further structural cohesion. The frame structure can include a top layer that extends along the top surface of each mattress module, the top layer having a thickness and material that are selected in accordance with a type of comfort.

In some embodiments, two adjacent mattress modules can be made of a different material.

In some embodiments, the unique body weight distribution is determined based on a morphological profile and a weight of the mattress user. Optionally, the body weight distribution can be determined based on the morphological profile, a weight and a sleep position of the mattress user.

In some embodiments, the given body posture is a natural body posture in accordance with a sleep position of the mattress user.

In another aspect, there is provided a method for designing a modular multi-zone mattress comprising a plurality of adjoined mattress modules defining an optimized sleep surface. The method includes collecting data related to pressure factors of a mattress user, the pressure factors including a weight and a morphological profile of the mattress user; selecting a number of the mattress modules in accordance with slope variations in the morphological profile; selecting a deformability of each one of the mattress modules resulting in a deformability profile of the sleep surface; and determining at least one of a body posture and a contact pressure distribution across the sleep surface based on the deformability profile of the sleep surface and the pressure factors of the mattress user. The steps of selecting the deformability of each one of the mattress modules and determining the at least one of the body posture and the contact pressure distribution are repeated until the at least one of the body posture and the contact pressure distribution is optimized.

In some embodiments, the method can include determining the body posture based on the deformability profile of the sleep surface and the pressure factors of the mattress user for a given contact pressure distribution.

In some embodiments, the method can include determining the contact pressure distribution based on the deformability profile of the sleep surface and the pressure factors of the mattress user for a given body posture.

In some embodiments, the method can include determining both the body posture and the contact pressure distribution based on the deformability profile of the sleep surface and the pressure factors of the mattress user.

Optionally, the body posture can be optimized when a natural body posture is met.

In some embodiments, the contact pressure distribution can be optimized when a gradient in the contact pressure provided by the sleep surface is minimized in both longitudinal and transverse directions.

In some embodiments, selecting the number of the mattress modules can include determining a number of inflection points encountered in a curvature of the morphological profile. Optionally, selecting the number of the mattress modules comprises determining the number of occurrences for which a slope variation $\Delta S$ meets a threshold value. Optionally, the method can include selecting a length of a top surface of each mattress module in accordance with the slope variations in a longitudinal morphological profile.

In some embodiments, the mattress modules comprise at least one end mattress module, and the method can further include adjusting a length of the at least one end mattress module to meet mattress standard size specification.

In some embodiments, collecting data related to the pressure factors can include manual measurement of a body shape of the mattress user. Alternatively, collecting data related to the pressure factors can include 3D-scanning of the body of the mattress user. Alternatively, collecting data related to the pressure factors can include determining a total height, an inside leg height, a hip height, an upper and lower waist height, an axilla height, an acromion height, a neck height, and a distance between anatomic landmarks of the body of the mattress user. Optionally, the pressure factors can further include a sleep position.

In some embodiments, selecting the deformability of each one of the mattress modules comprises selecting a material for each mattress module with a given density and mechanical properties. Optionally, the selection of the deformability for each mattress module can be performed among a finite number of available deformabilities.

In some embodiments, each step of the method can be performed via a manual assessment, a numerical analysis, a statistical model or an AI model.

In some embodiments, the method can further include determining an optimisation factor based on the at least one of the body posture and the contact pressure distribution for each repetition, and selecting the deformability profile resulting in the lowest optimisation factor. Optionally, the optimisation factor can be function of a rotation of the body in at least one of a sagittal plane or transverse plane. Further optionally, the optimisation factor is function of a force rendered by at least one mattress module upon being contacted with the mattress user.

The method can further include juxtaposing in a longitudinal direction the mattress modules in accordance with the selected deformability profile so as to produce the optimized sleep surface of the modular multi-zone mattress. Alternatively, the method can further include framing the juxtaposed mattress modules with a base layer, a top layer and side components.

In another aspect, there is provided a use of a numerical model to design a modular multi-zone mattress comprising a plurality of adjoined mattress modules defining a sleep surface. The numerical model is used to perform at least one of a determination of a number and dimensions of the mattress modules based on a morphological profile of a mattress user; a determination of a contact pressure or force distribution over the sleep surface based on the body weight distribution of the mattress user for a given sleep position; a determination of a variation in a body posture over the sleep surface with respect to a natural posture for a given sleep position; and a selection of a deformability of each selected mattress modules to provide at least one of an optimized contact pressure distribution and optimized body posture.

In another aspect, there is provided a use of a finite element numerical model to combine multiple modular mattress zones in accordance with an individual anthropometry of a mattress user, the finite element numerical model approximating the number of modular mattress zones, a shape of each modular mattress zone and a deformability of each modular mattress zone to provide at least one of an optimized contact pressure distribution and optimized body posture over the combined multiple modular mattress zones. In some implementations, the finite element numerical model is used to approximate the deformability of each modular mattress zone among a plurality of given deformabilities. In some implementations, the finite element numerical model is used to approximate the shape of each modular mattress zone among a plurality of given shapes.

While the invention will be described in conjunction with example embodiments, it will be understood that it is not intended to limit the scope of the invention to such embodiments. On the contrary, it is intended to cover all alternatives, modifications and equivalents as may be included as defined by the present description. The objects, advantages and other features of the present invention will become more apparent and be better understood upon reading of the following non-restrictive description of the invention, given with reference to the accompanying drawings.

BRIEF DESCRIPTION OF THE DRAWINGS

Implementations of modular multi-zone mattress and related design techniques are represented in and will be further understood in connection with the following figures.

Figure 1:
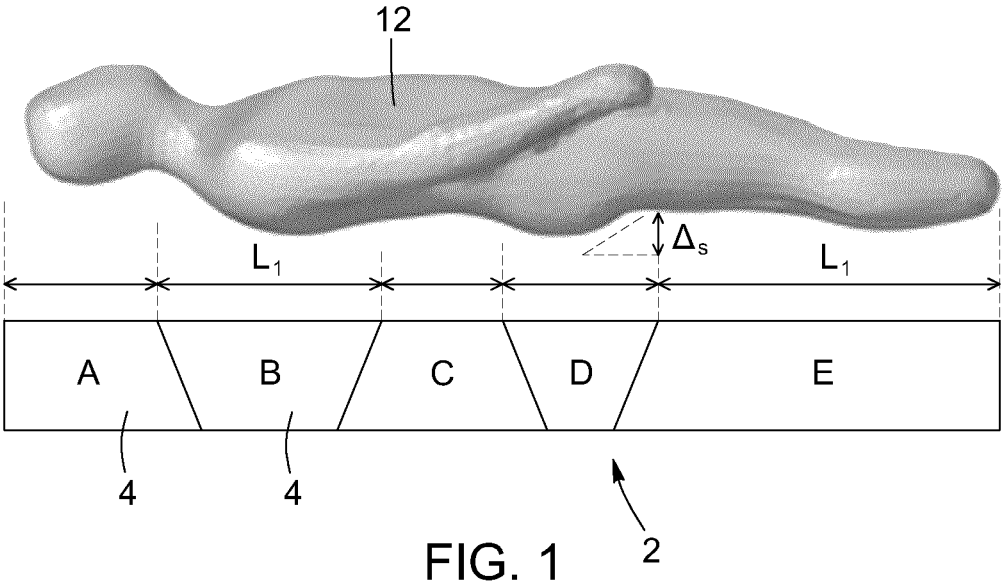
FIG. 1 is schematic cross-sectional view of an implementation of a modular multi-zone mattress along with a longitudinal morphologic profile of a mattress user.

While the invention is described in conjunction with example embodiments, it will be understood that it is not intended to limit the scope of the invention to these embodiments.

DETAILED DESCRIPTION

The modular multi-zone mattress proposed herein results from the combination of a plurality of mattress modules defining a sleep surface of variable deformability that is tailored to provide an optimized deformation response to a unique body weight distribution of a mattress user. The modular multi-zone mattress can thus be said to have an optimized sleep surface. The deformability of the modular multi-zone mattress can vary along a longitudinal axis of the mattress and further optionally along a transverse axis of the mattress. Each mattress module is made of a material of given deformability, and the geometric distribution of the mattress modules forming the mattress defines the deformability distribution along longitudinal and transverse axes.

Several factors, referred to as pressure factors, can be taken into account by the techniques described herein to account for the deformation of the sleep surface. These pressure factors include a weight and a morphology of the mattress user. The pressure factors can further include a sleep position of the mattress user. The sleep position is defined by the position adopted by the person when he or she lies on the sleep surface of the mattress, for example on the back (dorsal decubitus) or on the side (lateral decubitus).

The body weight distribution can be understood as a measure of the distribution of the body weight across the surface of the body in contact with the sleep surface. In accordance with the pressure factors, and thus depending on the distribution of the body weight for a given sleep position, pressure points of varying amplitude are applied to the sleep surface and cause deformation of the said sleep surface. The applied body weight distribution results in a contact pressure distribution across the entire sleep surface, for a given deformability profile of the sleep surface. It should be noted that the contact pressure distribution of the sleep surface in response to a given body weight distribution applied by the mattress user is considered herein as optimized when high-pressure points have a minimized amplitude and surface, when the contact pressure (related to the normal force) that is provided by the deformed sleep surface to the body surface is uniform (in longitudinal direction alone or in both longitudinal and transverse direction), when a gradient in the contact pressure provided by the deformed sleep surface is minimized, when local shear stress is minimized, when the area of the sleep surface that is in contact with the mattress user is maximized, or a combination thereof.

The deformability of the sleep surface can lead to a variation in the body posture. Certain variations in the body posture can provide an uncomfortable feeling to a mattress user. For example, a rotation of the body in the traverse plane will create more pressure in the left or right side while in the longitudinal plane, such that a section of the body would be placed deeper in the mattress than it should be. Multiple other variations in the body posture are encompassed herein, such as a change in the curvature of the spine or any modification of the positioning of a body part with respect to a plane or axis determining the natural posture.

Figure 18:
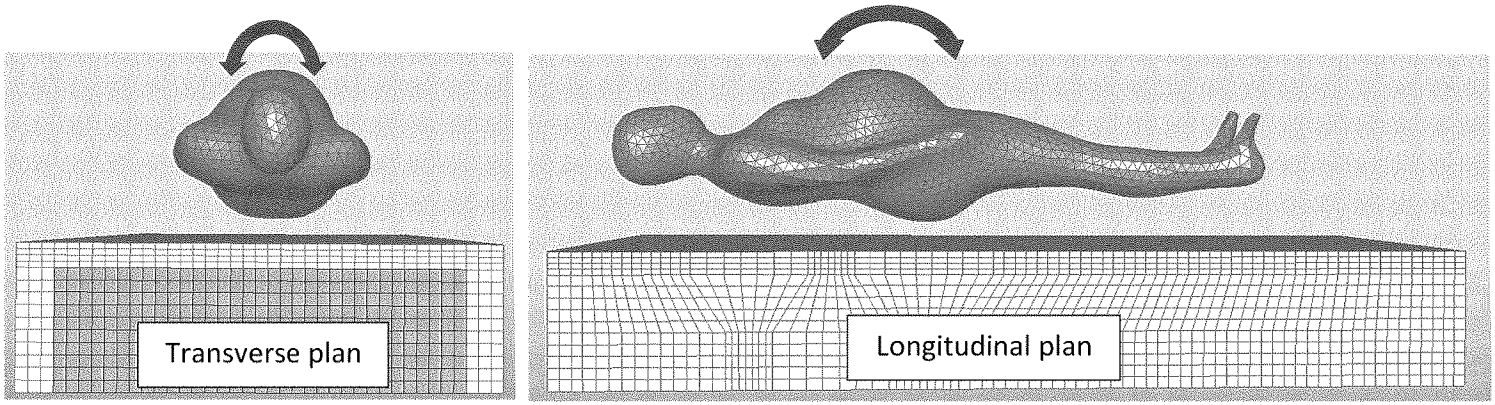
FIG. 18 is a schematic of a cross-sectional view of a mattress in a transverse direction (left) and in a longitudinal direction (right) with a side view of a 3D body shape of a mattress user showing possible rotation of the body.

The present modular mattress and related method of design provides a sleep surface that can be tailored to minimize the variation in the body posture with respect to a natural body posture resulting from the sleep position of the mattress user. For example, minimization of the variation in the body posture can be understood as minimizing the rotation of the body in the transverse plan and sagittal plan (see FIG. 18) with respect to a natural body posture (given by the sleep position). Ideally, no variation would be observed such that the natural body posture is maintained when the mattress user is lying over the sleep surface. It should be noted that the natural body posture deriving from the selected sleep position corresponds to an optimized body posture for which the spine curves correspond to the anatomic curves, which can be obtained by having the mattress user stand up straight naturally and comfortably, as it is shown for example in FIG. 14.

An optimized sleep surface as encompassed herein is to be understood as a sleep surface offering at least one of an optimized contact pressure distribution and a minimized body posture variation (also referred to as optimized body posture). Such optimized sleep surface can be considered as a "comfortable" sleep surface for a mattress user.

The techniques described herein include determination of the body weight distribution over the sleep surface based on a unique combination of pressure factors for each mattress user. The number of the mattress modules, dimensions of each mattress module and deformability of each mattress module can then be tailored to provide an optimized deformation response to the determined body weight distribution for a given body posture.

Mattress Implementations

Figure 2:
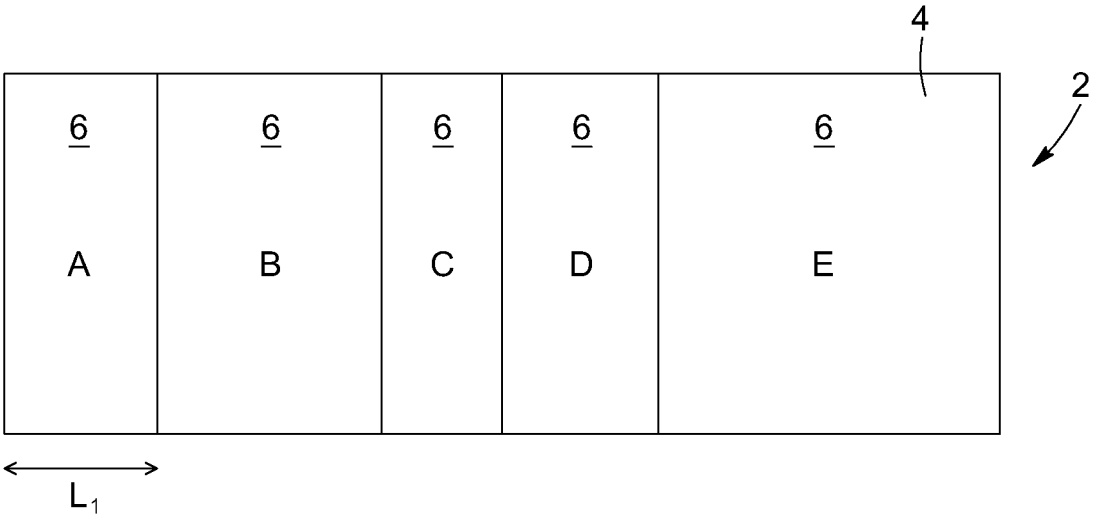
FIG. 2 is a schematic top view of an implementation of a modular multi-zone mattress showing a rectangular top surface of each mattress module having a varying length $L_1$.
Figure 10:
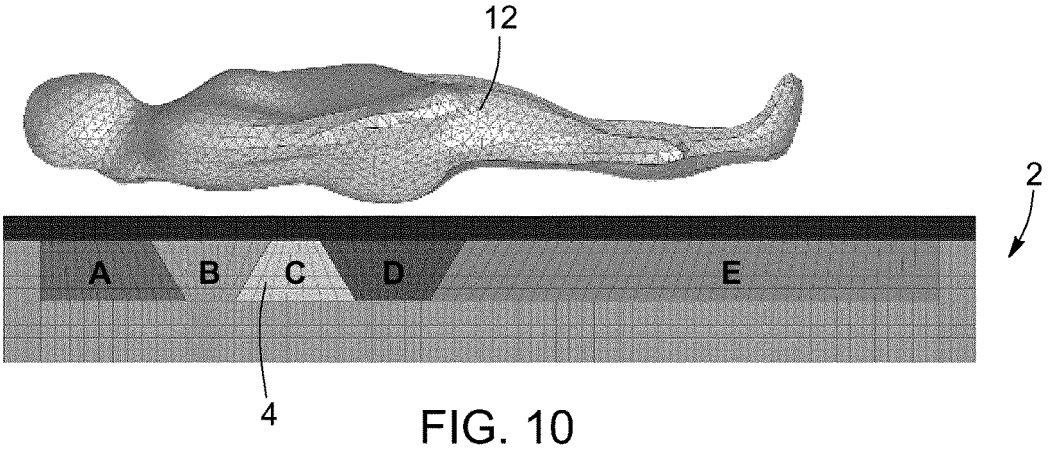
FIG. 10 is a schematic cross-sectional view of another implementation of a modular multi-zone mattress including multiple trapezoidal mattress modules in accordance with a same longitudinal morphologic profile of the mattress user as per FIG. 9.

Referring to FIGS. 1 and 2, the modular multi-zone mattress 2 includes multiple mattress modules 4 (A to E) that can be juxtaposed longitudinally such that a top surface thereof 6 forms the sleep surface. Referring to FIG. 10, at least the number of mattress modules 4 (A to L) can vary in response to variations in the slope of a longitudinal morphological profile 12 of the mattress user. More specifically, referring to FIG. 1, the number of mattress modules 4 and a length $L_1$ of a top surface of each mattress module 4A to 4E can vary in response to variations in the slope of the longitudinal morphological profile 12 of the mattress user.

The longitudinal morphological profile as used herein can be defined by a longitudinal curvature of varying slope of the body surface that is in contact with the mattress (from head to toe). The transverse morphological profile as used herein can be defined by a medio-lateral curvature of the body surface that is in contact with the mattress. The morphological profile as used herein refers at least to the longitudinal curvature, and further optionally to the medio-lateral curvature, of the body surface that is in contact with the mattress. Each change in slope along the longitudinal morphological profile can translate in a change in a body pressure applied to the sleep surface of the mattress.

Figure 9:
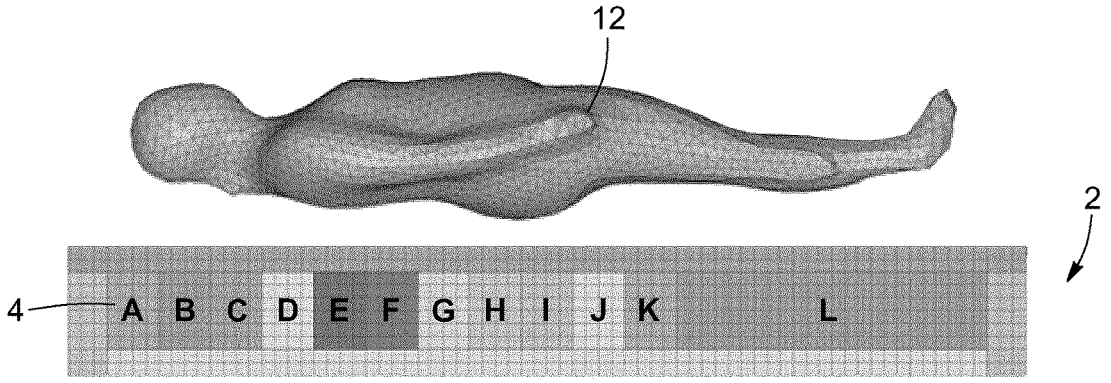
FIG. 9 is a schematic cross-sectional view of another implementation of a modular multi-zone mattress including multiple rectangular mattress modules in accordance with a longitudinal morphologic profile of a mattress user.

In some implementations, the number of mattress modules can be selected according to the slope variations of the morphological profile of each mattress user. For example, the modular multi-zone mattress can include at least three mattress modules having a top surface for supporting a head portion, an upper body portion and a lower body portion of the mattress user. In another example, referring to FIG. 1, the modular multi-zone mattress can include at least five mattress modules (A to E) having a top surface for supporting a head portion, a shoulder portion, a back portion, a bottom portion and a leg portion of the mattress user. Indeed, the morphological profile of a mattress user can include multiple inflection points for a given sleep position, when transitioning from one body portion to another body portion. Thus, the mattress can include a number of modules that is related to the number of inflection points encountered in the curvature of the morphological profile. More generally, the modular multi-zone mattress can include any number of mattress modules that is chosen in accordance with the number of curvature variations ΔS in the longitudinal morphological profile of the mattress user. As seen in FIG. 1, ΔS can be defined as a slope variation in the morphological profile (longitudinal profile alone or in combination with transverse profile). ΔS can be given a determined ΔS threshold, and each time a difference in the slope of the curvature of the longitudinal morphological profile meets the ΔS threshold, or an inflection point is found, an additional mattress module can be provided for combination with the other mattress module(s) until the entire sleep surface is formed. One can therefore understand that the lower the ΔS threshold is chosen, the higher the number of mattress modules will be for a given morphological profile. Referring to FIG. 9, one can see that the number of rectangular mattress modules is superior to the number of trapezoidal mattress modules illustrated in FIG. 10.

It is noted that the number of mattress modules forming the sleep surface of the modular multi-zone mattress includes two end mattress modules located at longitudinal extremities of the mattress and at least one internal mattress module located between the two end mattress modules. For example, in FIG. 1, the mattress modules 4A and 4E can be considered as the two end mattress modules. Referring to FIG. 9, the mattress modules 4A and 4L can be considered as the two end modules.

Figure 3:
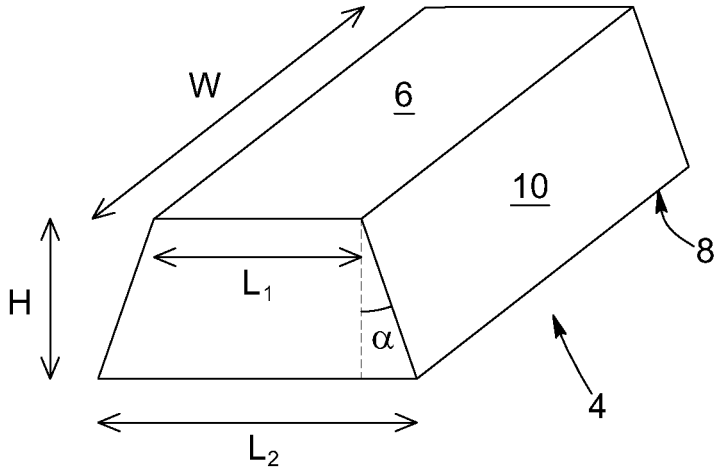
FIG. 3 is a schematic top perspective view of an implementation of a mattress module.
Figure 4:
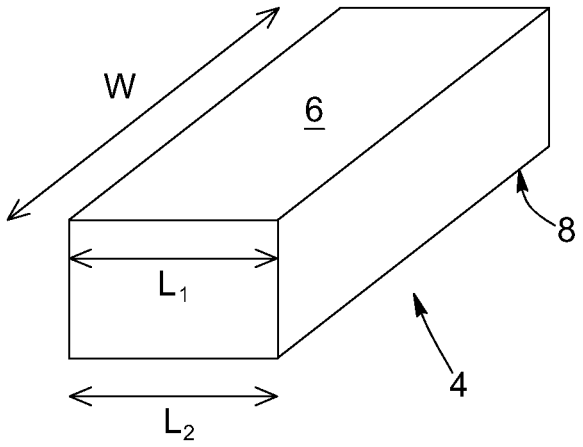
FIG. 4 is a schematic top perspective view of another implementation of a mattress module.

Referring to FIGS. 3 and 4, each mattress module 4 can be defined as a volume of mattress material having a top surface 6 of parallelepipedal shape, being substantially planar in an undeformed state, and configured to support a body portion of the mattress user when lying generally horizontally on the mattress module The top surface 6 of each mattress module is further defined by a top length $L_1$ that is taken in the longitudinal direction and a width W that is taken in a transverse direction. The top length $L_1$ and the width W of the mattress module define the size of the top surface 6 onto which the mattress user is lying down. This top surface 6 can also be referred to as a zone of the sleep surface, the sleep surface thereby including multiple zones that can have a varying length $L_1$ and further optionally, a varying shape.

Figure 7:
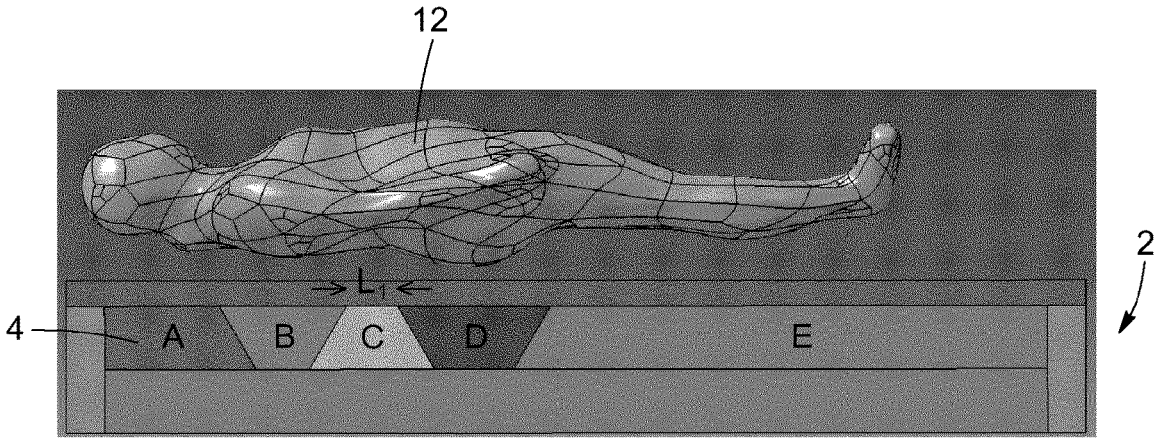
FIG. 7 is schematic cross-sectional view of another implementation of a modular multi-zone mattress along with a longitudinal morphologic profile of a mattress user.

For a given mattress dimensions, the size and shape of each mattress module can be determined in accordance with the number of mattress modules. Referring to FIG. 1, similarly to the number of mattress modules, one can see that the length $L_1$ of the top surface of each mattress module can be adapted to slope variations of the longitudinal morphological profile of each mattress user. For example, the length $L_1$ can be chosen in accordance with a length of each section of the longitudinal morphological profile having a change in slope equal or superior to the given ΔS threshold or being at an inflection point. For example, when comparing FIGS. 7 and 8, one can see that the length $L_1$ of the internal mattress modules B to D is differing in accordance with the two different longitudinal morphological profiles 12. It is noted that the length $L_1$ of the first end mattress module A (located below the head portion of the mattress user) can remain the same for specific morphotypes or even for all mattress users. It is further noted that the length of the end mattress module E can be chosen in accordance with a desired length of the mattress, so as to meet standard dimensions for example.

Figure 8:
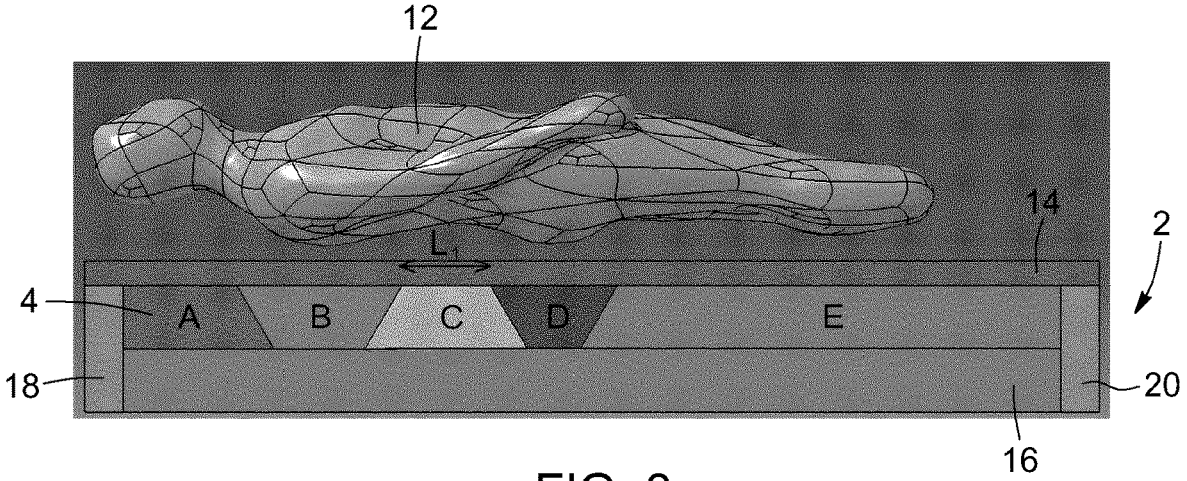
FIG. 8 is a schematic cross-sectional view of the same implementation of a modular multi-zone mattress as per FIG. 7 in accordance with another longitudinal morphologic profile of a mattress user.

As seen in FIG. 8 for example, the modular multi-zone mattress 2 can further include a frame structure surrounding the plurality of mattress modules 4 to further provide structural strength to the modular multi-zone mattress. More specifically, a top layer 14 can extend along a top surface of each mattress module 4, a bottom layer 16 can extend along a bottom surface of each mattress module 4, and side components 18 and 20 can be juxtaposed to the end transverse sides of the first and last mattress modules 4A and 4E. It is noted that the material and thickness of the top layer can be selected to provide a given type of comfort (e.g., firm, semi-firm, soft) to the mattress user while maintaining the uniform pressure response (contact pressure) provided by the combination of the mattress modules. It should be noted that the top surface of the mattress modules can be in direct contact with the mattress user; or differently, when a top layer is used over the top surface of the mattress modules, said top surface is not in direct contact with said mattress user. The sleep surface as referred to herein can therefore correspond to the top surface of the mattress modules or the top surface of an additional layer, depending on the composition of the modular mattress encompassed herein.

Optionally, the top surface of the mattress module can include curved portions that are adapted to further optimize the deformation response to the body weight distribution, for a given morphological profile of the mattress user. A first and end mattress module supporting a head portion of the mattress user can for example have a convex top surface to serve as a pillow. Further optionally, the mattress can then include a top layer having a bottom surface being curved complementarily to the top surface of the mattress modules.

Figure 13:
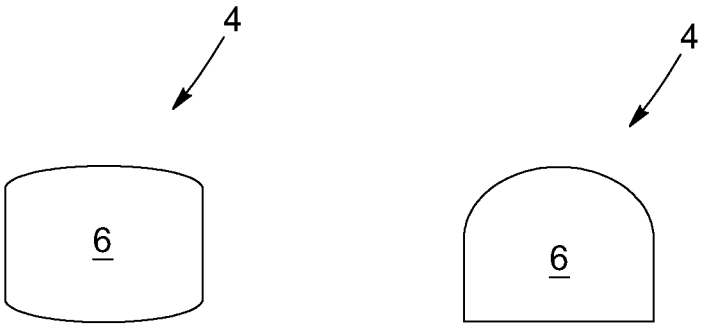
FIG. 13 is a schematic view of a top surface of a mattress module having a curved contour.

When referring to variable dimensions (also referred to as size and shape) of each mattress module, one should understand that at least the top length $L_1$ is optimized in accordance with the morphological profile of the mattress user. For example, in addition to the top length $L_1$, the shape of the top surface can differ from a rectangle and can include curves, as seen in FIG. 13, so as to be further optimized in accordance with the medio-lateral curvatures of the morphological profile of the mattress user.

Figure 5:
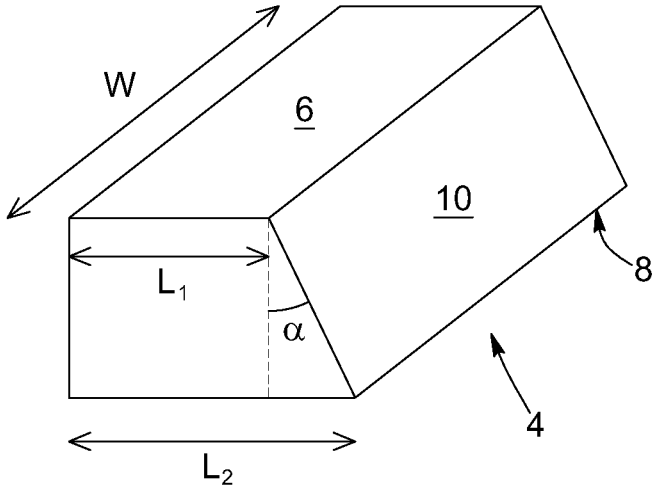
FIG. 5 is a schematic top perspective view of another implementation of a mattress module.
Figure 6:
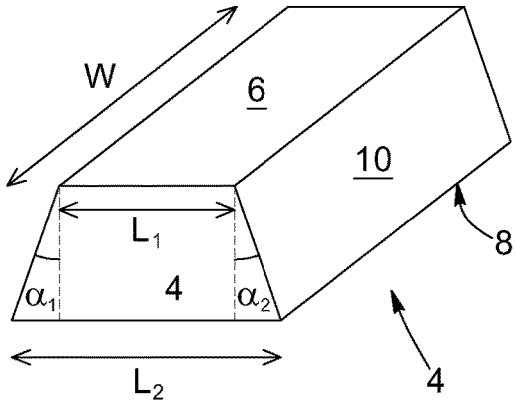
FIG. 6 is a schematic top perspective view of another implementation of a mattress module.

Referring to FIGS. 3, 5 and 6, the bottom surface 8 of each mattress module 4 can be shaped differently from the top surface 6. For example, a bottom length $L_2$ can be different from the top length $L_1$ of the mattress module 4. For example, at least one of the two opposed transverse sides 10 of the mattress module 4 can be tapered at an a angle. Referring to FIG. 3, both transverse sides can be tapered with the same angle. Referring to FIG. 5, only one transverse side 10 is tapered at an angle. Referring to FIG. 6, both transverse sides are tapered at an angle but the angle ($\alpha_1$ or $\alpha_2$) is different for each side. It is noted that the two mattress modules located at longitudinal extremities of the mattress (e.g. A and E in FIGS. 1 and 2) can include a non-tapered end transverse side to accommodate standard mattress shape, as seen on FIGS. 4 and 5.

Tapering the internal transverse sides of the mattress modules allows for a gradual transition in deformability from the top surface of one mattress module to the top surface of the adjacent mattress module. The bottom length $L_2$ and the angles ($\alpha_1$ and $\alpha_2$) defined by the transverse sides of the mattress module can be further optimized in accordance with a difference in deformability between two adjacent mattress modules. For example, the bigger the difference in deformability is between a first mattress module and a second adjacent mattress module, the more tapered the facing transverse sides of the first and second mattress can be. The angles are further limited by the resulting bottom length $L_2$ of the mattress modules, so as to accommodate a given total length of the mattress.

It is noted that the width W of each mattress module is to be chosen in accordance with a width of the overall mattress and can be generally the same for all the mattress modules forming the mattress. It is noted that the width W of the mattress modules can further be chosen based on standard single bed dimensions. It is further noted that the height H of each mattress module can be generally the same for all the mattress modules forming the mattress so as to adapt to standard mattress thicknesses. It should further be noted that the height of the mattress module can account for the presence of a top layer and a base layer to match standard mattress thicknesses. Alternatively, the height of each mattress module can also be a parameter that can vary to optimize the deformation response to the body weight distribution of the mattress user.

Deformability is defined by the nature, the density, and the mechanical properties of the building material of the mattress module. Any known building material in the field of mattresses can be used to provide a desired deformability to each mattress module, and can include polyurethane foam (e.g., with density varying from 1.5 PCF (Pounds per Cubic Feet) to 5 PCF), viscoelastic foam or memory foam (e.g., with density varying from 2.5 PCF to 6 PCF) and latex (e.g., with density varying from 3 PCF to 6 PCF). It is noted that several mattress modules of the modular multi-zone mattress, whether they are juxtaposed or not, can be made of a same material or of a material having substantially the same density and/or mechanical properties.

Method Implementations

Each mattress user is characterized by a unique combination of weight and morphology defining ergonomic needs that cannot be fully matched by a sleep surface designed based on general anthropometry only. The present modular multi-zone mattress is configured to take into account the weight and the morphology of each mattress user. Optionally, in addition to weight and morphology, sleep position of the mattress user (including supine position, prone position and lateral position) can be considered as another pressure factor impacting the general distribution of body weight applied to the sleep surface, and a depth of each of these pressure points.

The techniques described herein include collecting data related to the morphological profile of the mattress user and selecting a number of mattress modules in accordance with slope variations in the morphological profile for a given sleep position. Once the number of mattress modules is determined, the deformability of each mattress module can be selected in accordance with the body weight distribution for a given mattress user so as to create the optimized sleep surface as defined herein. Thus, each mattress module has a deformability tailored to a specific body pressure range imposed by the mattress user. For example, the selection of deformability for each mattress module can be performed to provide an overall sleep surface having an enhanced contact pressure profile (compared to a mattress of unique deformability and lacking the modular configuration).

Figure 11:
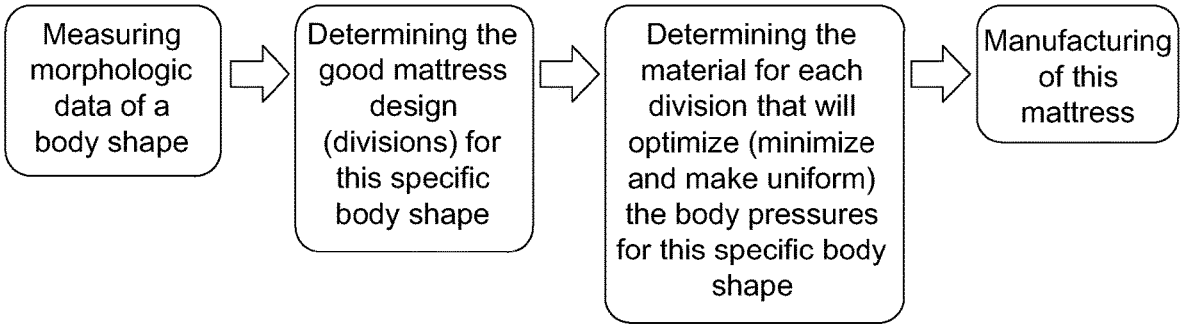
FIG. 11 is a schematic of the general steps of a method for designing mattress modules and assembly of the modular multi-zone mattress.
Figure 12:
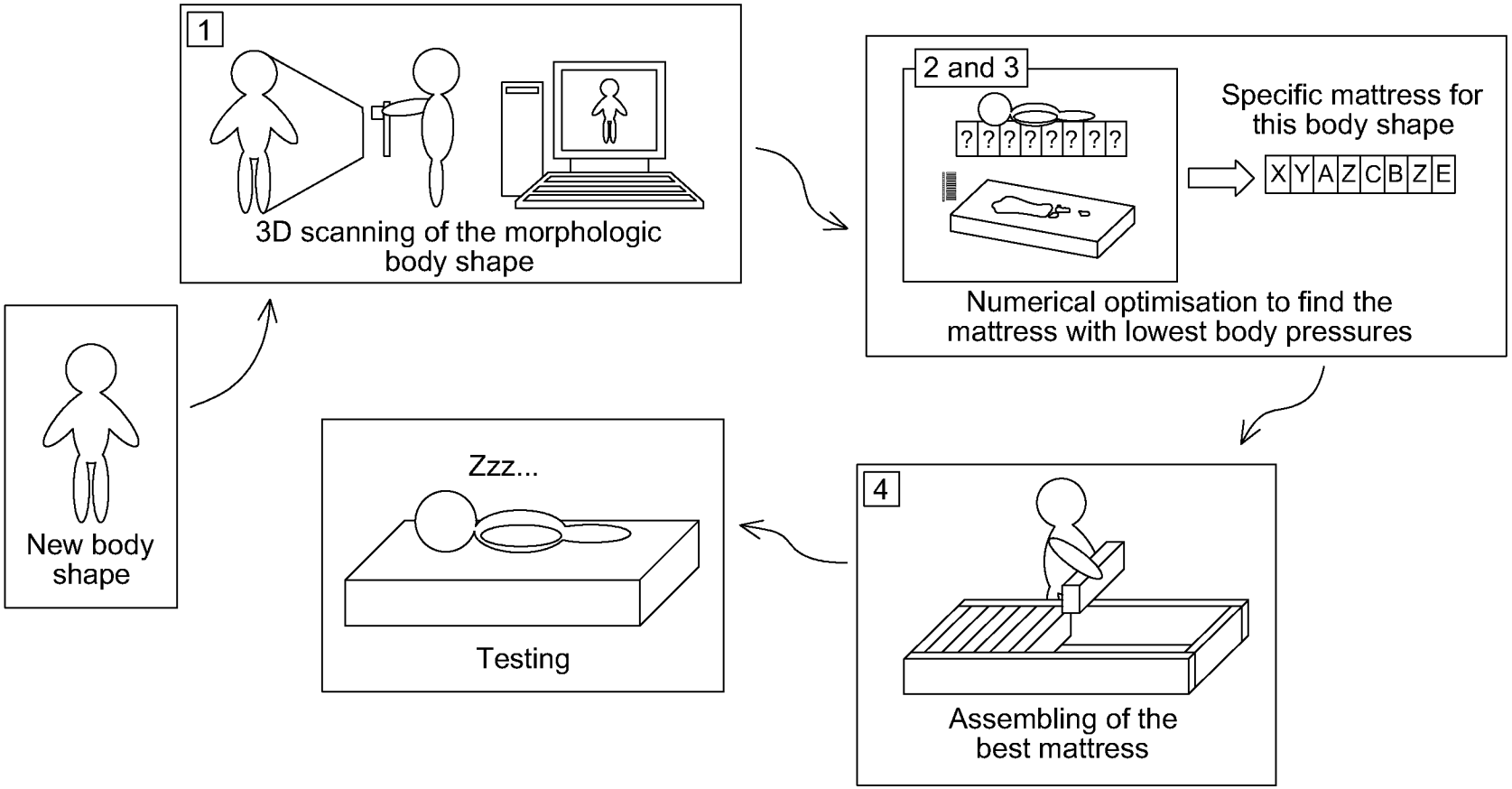
FIG. 12 is a schematic of the general steps of a method for designing mattress modules and assembly of the modular multi-zone mattress when using a 3D body scan.

Referring to FIGS. 11 and 12, a first step (step 1) of the method is the collection of data related to the pressure factors of the mattress user. Such pressure factors include the weight of the mattress user and a morphology of said user. Collecting data related to the morphology of the mattress user can be performed in various ways including manual measurements of a body shape of the mattress user, and 3D-scanning of the body of the mattress user. For example, measurements of the body shape can include measuring a total height, inside leg height, hip height, upper and lower waist height, axilla height, acromion height, neck height and distance between anatomic landmarks. The measurements can further include width and thickness at each of these anatomic landmarks (excepted for a total height). The measurements can further include a circumference at each of these anatomic landmarks. It should be understood that the minimal data required are measurements providing the weight and a satisfying morphological profile of the mattress user, so as to produce a body weight distribution and a correlated body pressure distribution including maximal pressure points.

Still referring to FIGS. 11 and 12, the method further includes selecting the number of the mattress modules and dimensions of each mattress module based on the morphological profile (step 2). Optionally, selecting dimensions of each mattress module can include selecting a length $L_1$ of the top surface of each mattress module. Further optionally, selecting dimensions of each mattress module can include selecting a shape of the top surface of each mattress module.

The selection of the number and dimensions of the mattress modules can be performed in various ways including visual analysis or numerical analysis. For example, referring to FIG. 1, the number and dimensions of the mattress modules 4 can be selected via a visual analysis of the morphological profile 12 by locating inflection points (or slope variations that would be equal or superior to a slope variation threshold) in the longitudinal morphological profile. Alternatively, the combination of the number and dimensions of each mattress module can be determined via a numerical analysis based on a mathematical (numerical) model enabling automatic calculation of these variables based on the morphological profile of the mattress user.

The method can include selecting a length of the last end mattress module in accordance with a desired length of the sleep surface of the mattress. The length of the last end mattress can simply be obtained by subtracting the length of the remaining mattress modules to a total desired length.

Still referring to FIGS. 11 and 12, the method further includes selecting a deformability of each mattress module based on the body weight distribution for a given mattress user (step 3). Selecting the deformability can be assimilated to selecting a material of given nature, density and mechanical properties for each mattress module. It should be noted that the selection of the deformability of each one of the mattress modules can be tailored to provide an optimized contact pressure distribution for a given body posture, an optimized body posture for a given contact pressure distribution, or a combination of both.

The selection of the deformability of each one of the mattress modules to provide at least one of the optimized contact pressure distribution and the optimized body posture can be performed in various ways, including manual assessment and numerical analysis.

For example, the numerical analysis can be the result of an analytical, statistical or finite element model. Each of these numerical models can be used to associate the weight of the mattress user to the corresponding morphological profile to determine a body weight distribution of the body surface in contact with the sleep surface of the mattress, and then to generate the contact pressure distribution over the sleep surface for a given combination of mattress modules. The numerical model can be further used to select a deformability for each of the determined number of mattress modules so as to form a sleep surface having a varying deformability profile that provides an optimized contact pressure distribution. For example, the resulting sleep surface has a varying deformability profile that is selected to produce a surface pressure response of enhanced uniformity when the body weight distribution of the mattress user is applied thereto.

The selection of the deformability can include selecting a density of the building material of the mattress module. It is noted that the selection of the deformability for each mattress module can be performed among a finite number of available deformabilities. For example, the numerical model is run as a loop that will end when a combination of selected deformabilities for the mattress modules satisfies a given uniformity criterion or optimisation factor corresponding to the pressure response of the sleep surface (optimized contact pressure distribution), the optimized body posture, or both. More particularly, the numerical model can be given densities of available building material and the selection of the deformability can include selecting a building material of given density. Additional mechanical properties of the building material, such as Young modulus, Poison ratio, bulk modulus, shear modulus, viscoelastic parameters, stress-strain curves, or a combination thereof can be used as input data of the numerical model to assist in the selection of an optimized deformability profile.

In some implementations, the selection of the deformability profile for a given body weight distribution can be performed based on a numerical model including the use of a mathematical expression that evaluates the performance of different combinations of mattress modules of given deformability based on an optimisation factor taking into account at least one of the maximal force provided by a mattress module (e.g., shoulder module) and the variation of the body posture (e.g., rotation). The numerical model compares the performance of one mattress with respect to multiple other mattresses, and selects the mattress having the smallest optimization factor (best performance). For example, in below Equation (1), each mattress (i) is compared to the other n mattresses using a normalized function taking into account the normalized maximal forces of three different mattress modules (shoulder module, lumbar module and pelvic module). The smallest resulting optimization factor will correspond to the modular mattress having the lowest maximal forces at the shoulder and pelvis module, and the highest maximal force at the lumbar module (as lumbar curve is not always in contact with the sleep surface). Imposing the highest force at the lumbar module allows to maximize the contact of the sleep surface with the lumbar region of the body, such that the contact pressure distribution is optimized.

Equation (1)

$$\text{Optimisation factor}_i = \sqrt{\left(\frac{ForceShoulderBloc_i}{\max(ForceShoulderBloc_{1-n})}\right)^2 + \left(1 - \frac{ForceLumbarBloc_i}{\max(ForceLumbarBloc_{1-n})}\right)^2 + \left(\frac{ForcePelvisBloc_i}{\max(ForcePelvisBloc_{1-n})}\right)^2}$$

The numerical model can be adapted to evaluate the sleep surface based on another criteria, that is the minimization of the variation in the body posture with respect to the natural body posture given by the sleep position. For example, in below Equation (2), each mattress (i) is compared to the other n mattresses using a normalized function taking into account the rotation energy of the chest in the sagittal plane.

The smallest resulting optimization factor will correspond to the modular mattress having the smallest rotation energy (optimized body posture).

$$\text{Optimisation factor}_i = \left(\frac{\text{Rotation energy}_i}{\max(\text{Rotation energy}_{1-n})}\right) \quad \text{Equation (2)}$$

The numerical model can be further adapted to evaluate the sleep surface based on all of the above criteria. For example, in below Equation (3), each mattress (i) is compared to the other n mattresses using a normalized function taking into account the rotation energy of the body, and the normalized forces of three different mattress modules (shoulder module, lumbar module and pelvic module). The smallest resulting optimization factor will correspond to the modular mattress having the smallest rotation energy (optimized body posture), the lowest forces at the shoulder and pelvis module, and the highest force at the lumbar module (as lumbar curve is not always in contact with the sleep surface).

Equation (3)

$$\text{Optimisation factor}_i = \sqrt{\left(\frac{\text{Rotation energy}_i}{\max(\text{Rotation energy}_{1-n})}\right)^2 + \left(\frac{ForceShoulderBloc_i}{\max(ForceShoulderBloc_{1-n})}\right)^2 + \left(1 - \frac{ForceLumbarBloc_i}{\max(ForceLumbarBloc_{1-n})}\right)^2 + \left(\frac{ForcePelvisBloc_i}{\max(ForcePelvisBloc_{1-n})}\right)^2}$$

It should be noted that a same numerical model having the weight and morphological profile as input data can be established to perform determination of the number and dimensions of the mattress modules based on the morphological profile, determination of the at least one of the contact pressure distribution and the body posture based on the weight and the morphological profile, and selection of the deformability of each selected mattress modules to provide an optimized sleep surface.

Other ways to select the deformability of each one of the mattress modules and provide an optimized sleep surface can include the use of a statistical model that uses the morphology of a given mattress user and compares it to a data bank of combinations of mattress modules for known mattress users to generate a combination of mattress modules (number, dimensions and deformability) that is tailored to the given mattress user. The data bank includes information related to the weight, morphology and related modular multi-zone mattress for past mattress users. Another possibility to build the optimized modular mattress for a specific morphology is to use a trained artificial intelligence (AI) model. The AI model can be trained to determine, based on existing association of morphologies and mattress module deformabilities, the best material for a given morphology and weight. The AI model can be periodically or continuously retrained as new morphologies and material characteristics are added to the databases.

It should however be noted that selection of the deformability for each mattress module can be performed manually. For example, one could combine the determined number of mattress modules with given deformability and assess at least one of the contact pressure distribution and the body posture when the mattress user is in a given sleep position. If the contact pressure distribution or the body posture is not considered as optimized (large gaps between body and sleep surfaces or pressure points felt by the mattress user, excessive rotations), the number and/or material of the mattress modules could be varied until a satisfactory and optimized sleep surface is found.

It should further be noted that certain steps of the method described herein can be performed manually while other can be performed with the assistance of a numerical analysis, a statistical model or an AI model. For example, selection of the deformability of the mattress modules can be performed manually while the determining of at least one of the resulting body posture and contact pressure distribution can be performed via numerical simulation.

Referring to FIGS. 11 and 12, the method then includes juxtaposing in a longitudinal direction, and optionally in a transverse direction, the mattress modules in accordance with the determined deformability profile so as to produce the sleep surface of the modular multi-zone mattress (step 4). Optionally, referring to FIG. 8, the method can finally include framing the juxtaposed mattress modules 4 with the base layer 16, a top layer 14 and the side components 20.

It should be noted that the method can include performing the steps as defined above for more than one mattress user, e.g., two mattress users, and combine the selected mattress modules so as to form a two-people modular multi-zone mattress having two different optimized sleep surfaces distributed transversally.

It should be noted that the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The embodiments, geometrical configurations, materials mentioned and/or dimensions shown in the figures are optional, and are given for exemplification purposes only. Therefore, the descriptions, examples, methods and materials presented in the claims and the specification are not to be construed as limiting but rather as illustrative only.

Although the implementations of the modular multi-zone mattress and corresponding parts thereof consist of certain geometrical configurations as explained and illustrated herein, not all of these components and geometries are essential and thus should not be taken in their restrictive sense. Moreover, it will be appreciated that positional descriptions such as "above", "below", "first", "last" and the like should, unless otherwise indicated, be taken in the context of the figures and should not be considered limiting.

In the above description, an implementation or embodiment is an example of the invention. The various appearances of "one embodiment," "an embodiment" or "some embodiments", "an implementation", "some implementations" do not necessarily all refer to the same example. Although various features of the invention may be described in the context of a single implementation, the features may also be provided separately or in any suitable combination. Conversely, although the invention may be described herein in the context of separate implementations for clarity, the invention may also be implemented in a single implementation.

It should be understood that any one of the above-mentioned optional aspects of each the mattress, designing method and use of a model to design the mattress may be combined with any other of the aspects thereof, unless two aspects clearly cannot be combined due to their mutual exclusivity. For example, the various operational steps of the method described herein-above, herein-below and/or in the appended Figures, may be combined with any description of the structural elements of the mattress appearing herein and/or in accordance with the appended claims.

EXAMPLES

Two examples of stress distribution (corresponding to the contact pressure distribution at the interface between the sleeper and the top surface of the mattress) for 3 different mattresses for two mattress users are provided below.

Mattress Users Presentation

Figure 14:
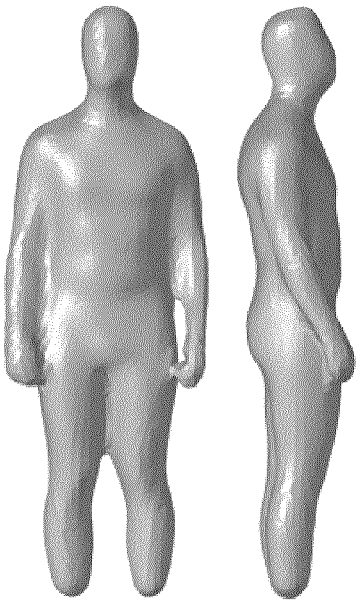
FIG. 14 is a front and side view of a generated 3D body shape for male and female mattress users.
Figure 14:
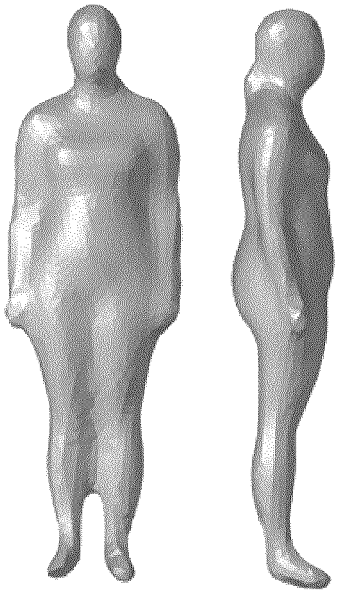

Two mattress users with different morphological body shape (profile) and weight were studied. The morphological body shape of each mattress user was obtained with a 3D scanner, while the weight was obtained with a scale. The corresponding front and side views of the collected morphological body shape of a male mattress user and a female mattress user are seen in FIG. 14.

Mattresses Description

Figure 15:
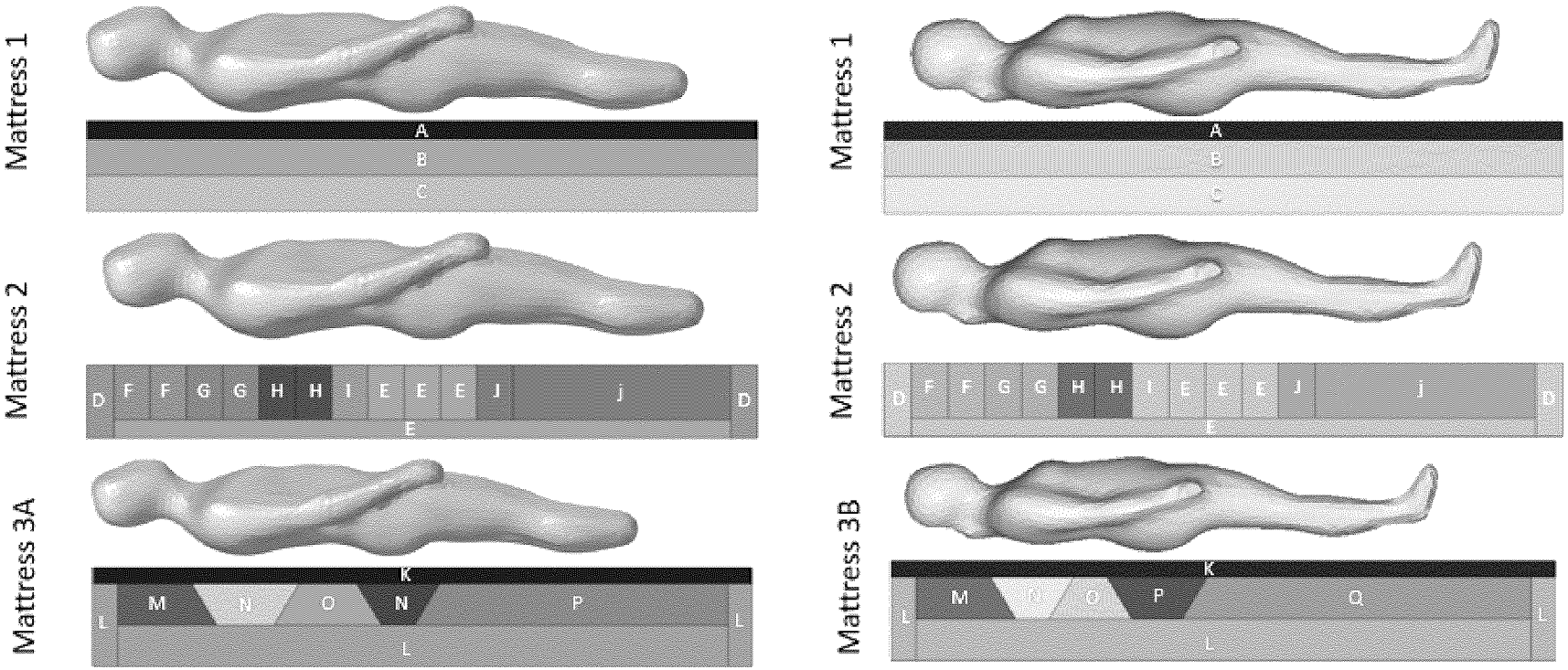
FIG. 15 is a schematic of a cross-sectional view of different mattresses combined with a side view of a 3D body shape of a mattress users of FIG. 14 positioned in a supine position above a sleep surface.

Referring to FIG. 15, three different mattress designs (1, 2, 3A and 1, 2, 3B) were tested for each mattress user. Accordingly, three different contact pressure distributions were obtained. Mattress 1 is a standard type mattress as readily known in the art including a base layer, an intermediate support layer and a top comfort layer. Mattresses 2, 3A and 3B correspond to mattresses as encompassed by the implementations described herein.

Each letter represents a specific material for the mattress module. In this example, mattresses 1 and 2 are composed of the same materials for both mattress users. Mattress 3A differs from mattress 3B in terms of module dimensions and materials for each mattress user.

Mattresses Performances

Body Support

Figure 16:
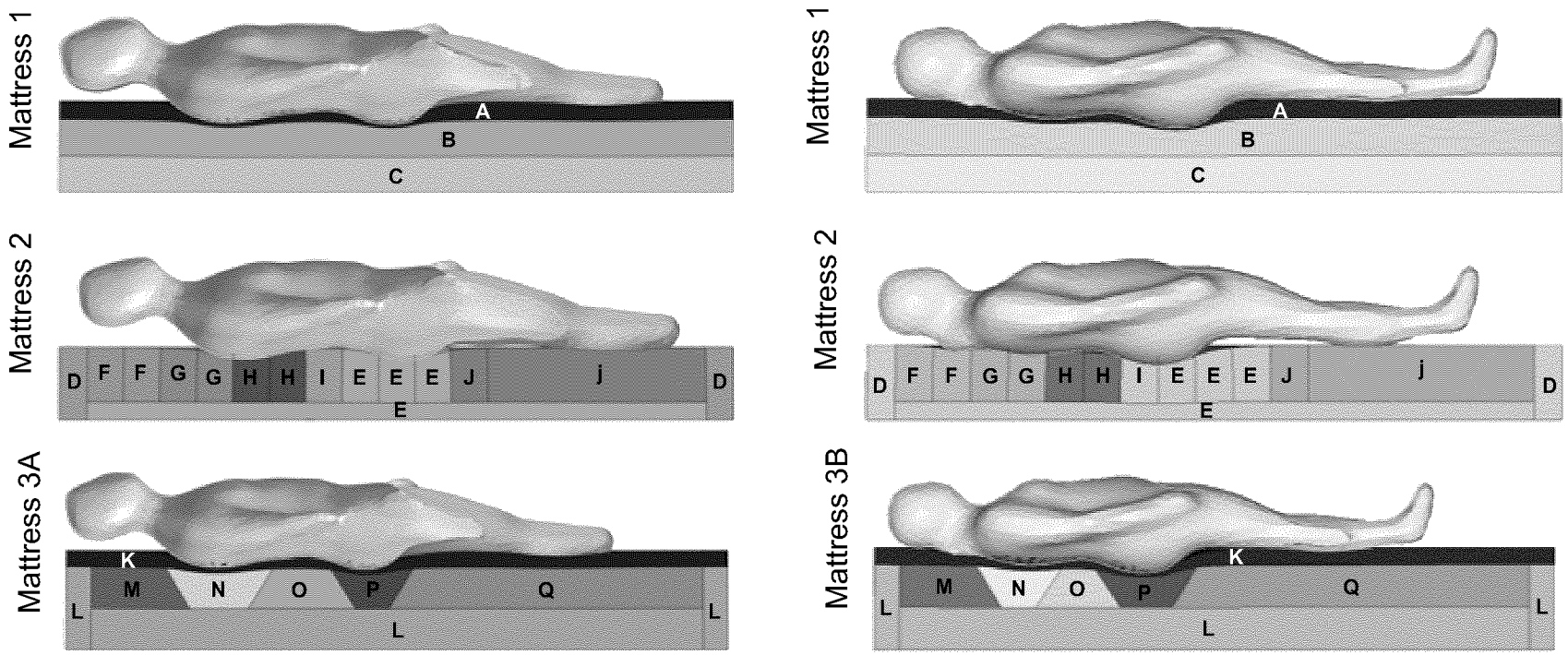
FIG. 16 is a schematic of a cross-sectional view of different mattresses having a deformed sleep surface combined with a side view of a 3D body shape of the mattress users of FIG. 14 positioned in a supine position over the sleep surface.

Referring to FIG. 16, when visually assessing the support provided to the longitudinal morphological profile of the mattress users, one can observe that mattress 2 does not provide enough support in the lumbar region. Indeed, there is a gap (no contact) between the back and the sleep surface for both mattress users. Little or no contact between the mattress user and the sleep surface creates high-pressure zones at the sleeper-bed interface where the body is in contact with the mattress. For example, if there is no contact in the lumbar region, the contact pressure will be higher in the thoracic and sacral regions. When comparing mattress 3A or 3B with mattress 2, the presence of lumbar gap demonstrates that the shape and the material that compose the mattress modules impacts the optimization of the contact pressure distribution.

Optimized Contact Pressure Distribution

Figure 17:
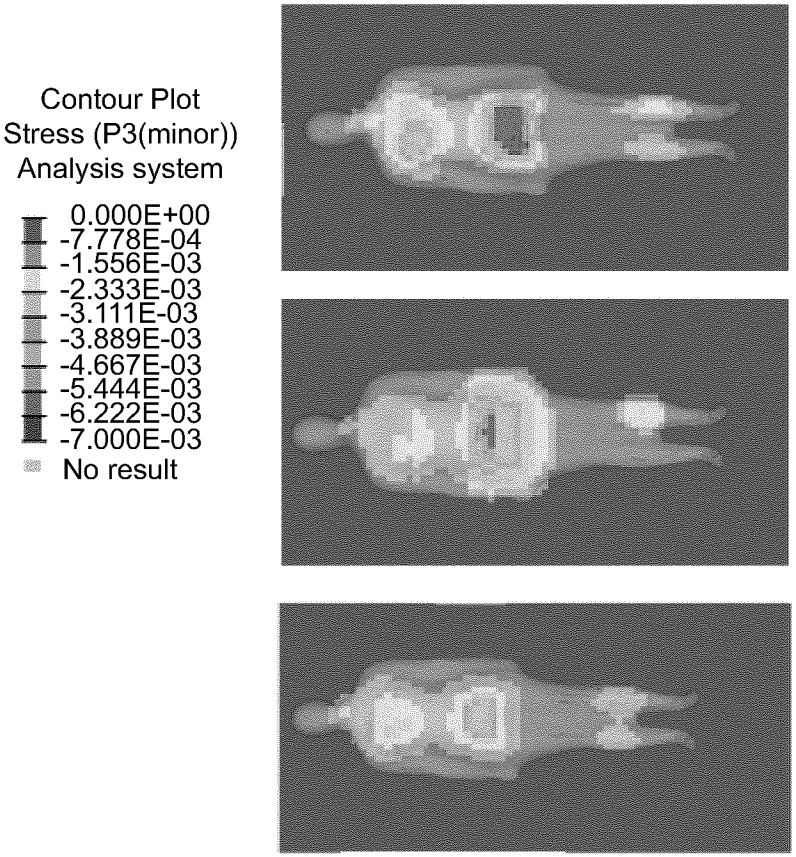
FIG. 17 is a graphic representation of a body pressure distribution over the deformed sleep surface of each mattress illustrated in FIGS. 15 and 16.
Figure 17:
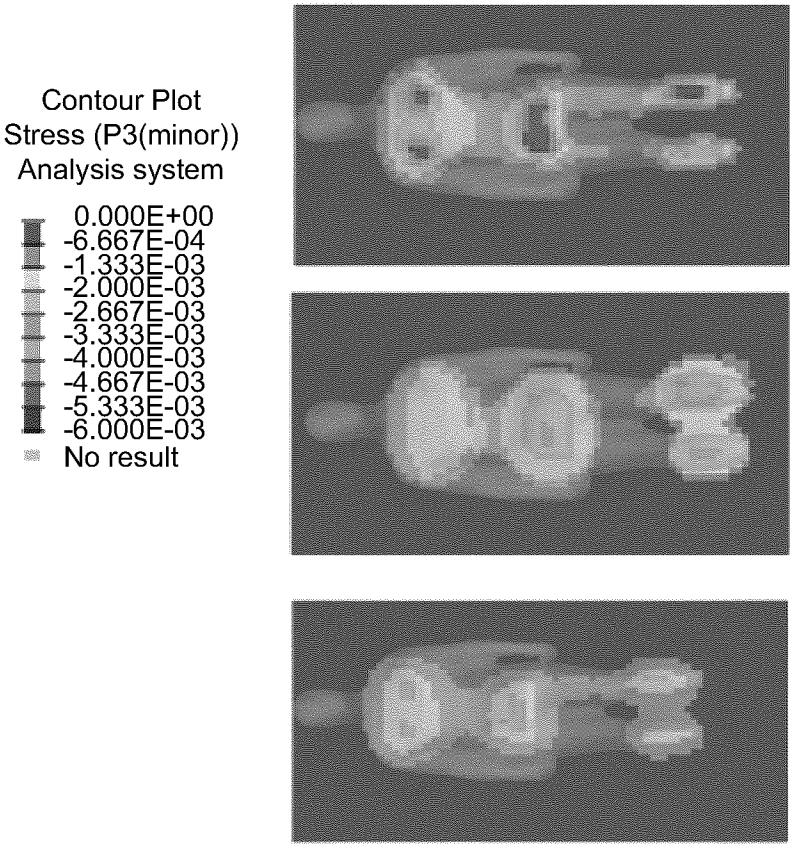

FIG. 17 shows the pressure mapping over the sleep surface in response to the application of the body weight distribution of the mattress user for each of mattresses 1, 2, 3A and 3B. For both mattress users, mattress 1 induces higher contact pressure regions in the contact pressure distribution than the other mattresses. With mattress 2, higher contact pressure regions are reduced, but some areas of the contact pressure distribution (corresponding to a change of module and material) still present large contact pressure variation. Mattress 3A and 3B provide the lowest contact pressure regions and the contact pressure gradients are minimized in comparison to the other mattresses. One can thus see that the optimization of the contact pressure distribution at the interface between the mattress user and the sleep surface is better for mattress 2, 3A and 3B (having longitudinal distribution of mattress modules) than for mattress 1, and that the optimization of the contact pressure distribution is even better for mattresses 3A and 3B (having tapered mattress modules) than for mattress 2.

Minimized Variation in the Body Posture

Figure 19:
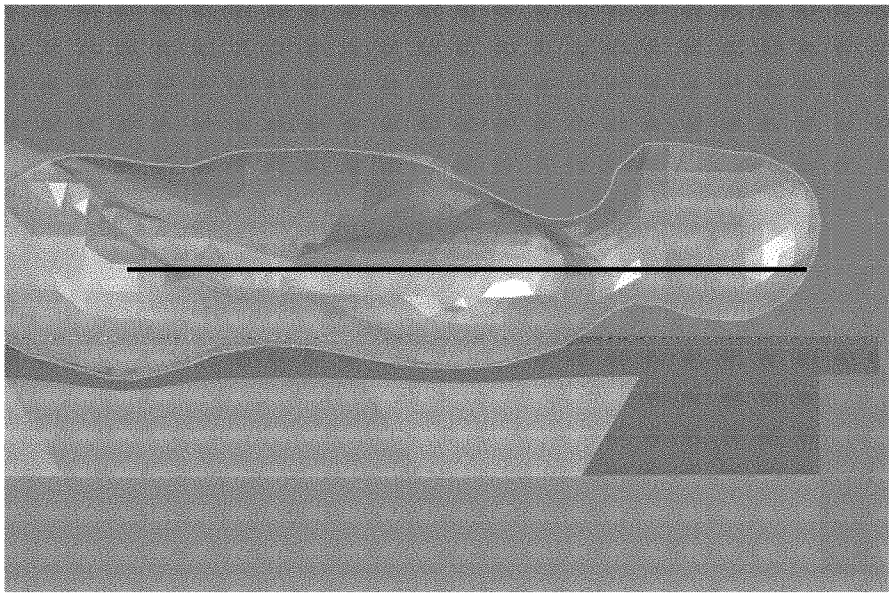
FIG. 19 is a schematic of a cross-sectional view of a modular mattress in a longitudinal direction with a side view of a 3D body shape of a mattress user in a natural body posture maintaining horizontal alignment.
Figure 20:
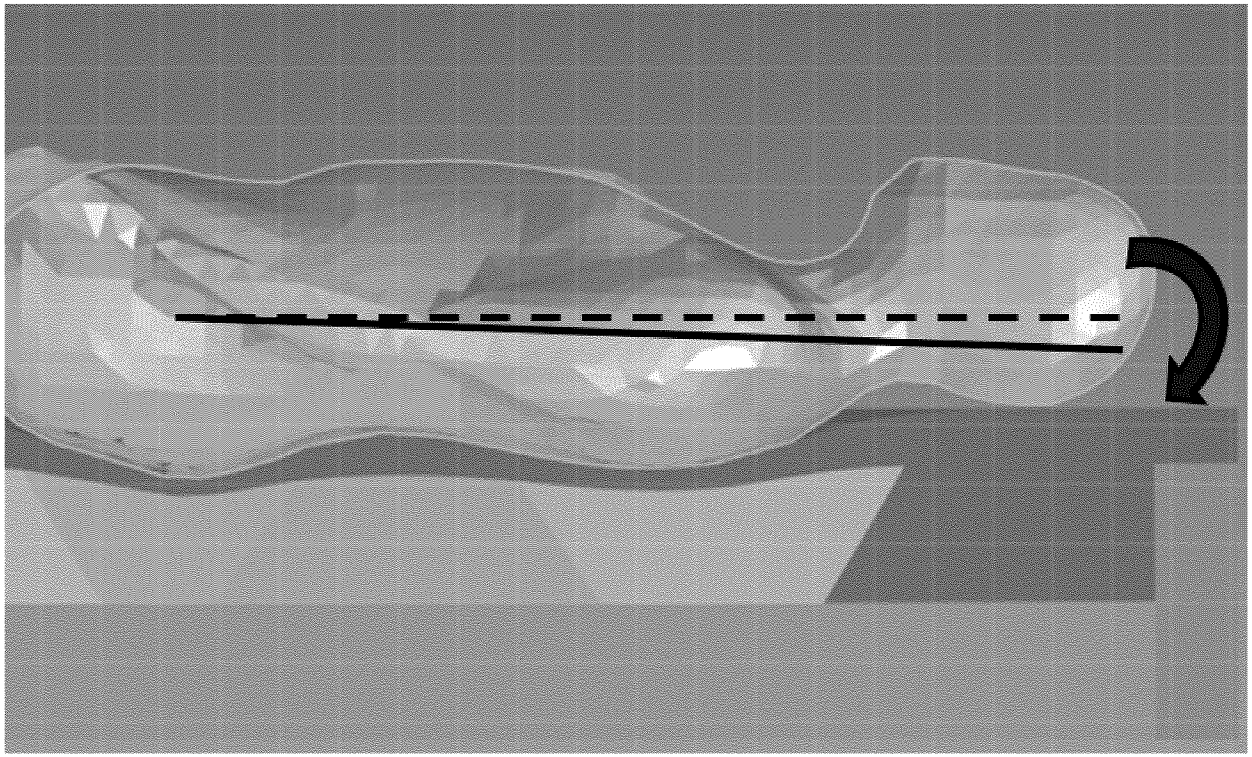
FIG. 20 is a schematic of a cross-sectional view of a modular mattress in a longitudinal direction with a side view of a 3D body shape of a mattress user in a deviated body posture resulting from a downward body rotation.

FIG. 19 shows a side view of a 3D modelisation of a body that lies in a back sleep position on the present modular mattress having an optimized sleep surface that maintains the natural body posture or at least minimize the variations in the body alignment. As can be seen on FIG. 19, the natural posture follows a substantially horizontal axis when the mattress user lies down. The selected combination of mattress modules of trapezoidal shape shown in FIG. 19 can provide an optimized body posture to the mattress user in the sense that the mattress can maintain the natural body posture in a given sleep position, differently to the combination of mattress modules shown in FIG. 20 where the body posture is allowed to slightly vary via a rotation of the shoulders. This rotation occurs by the fact that the material is softer at the shoulders for the second mattress. Minimizing variations in the body posture with respect to the natural body posture can have a role in the comfort evaluation but also in providing an adequate spine support.

The invention claimed is:

1. A method for selecting a plurality of mattress modules forming a modular multi-zone mattress having an optimized sleep surface when adjoined, the method comprising the following steps:

a) collecting data related to pressure factors of a mattress user, the pressure factors including a weight and a morphological profile of the mattress user;

b) selecting a number of the mattress modules in accordance with slope variations in the morphological profile;

c) selecting a deformability of each one of the mattress modules resulting in a deformability profile of the sleep surface;

d) determining at least one of a body posture and a contact pressure distribution across the sleep surface based on the deformability profile of the sleep surface and the pressure factors of the mattress user; and e) determining an optimisation factor based on the at least one of the body posture and the contact pressure distribution, wherein the steps c), d), and e) are repeated until the deformability profile results in the optimisation factor that provides for the optimized sleep surface when the plurality of selected mattress modules are adjoined, and wherein the method further comprises juxtaposing in a longitudinal direction the selected mattress modules to produce the optimized sleep surface of the modular multi-zone mattress.

2. The method of claim 1, comprising determining the body posture based on the deformability profile of the sleep surface and the pressure factors of the mattress user for a given contact pressure distribution.

3. The method of claim 1, comprising determining the contact pressure distribution based on the deformability profile of the sleep surface and the pressure factors of the mattress user for a given body posture.

4. The method of claim 1, comprising determining both the body posture and the contact pressure distribution based on the deformability profile of the sleep surface and the pressure factors of the mattress user.

5. The method of claim 1, wherein the deformability profile results in the optimisation factor providing for the optimized sleep surface when a natural body posture is met.

6. The method of claim 1, wherein the deformability profile results in the optimisation factor providing for the optimized sleep surface when a gradient in the contact pressure of the contact pressure distribution provided by the sleep surface is minimized in both longitudinal and transverse directions.

7. The method of claim 1, wherein selecting the number of the mattress modules comprises determining a number of inflection points encountered in a curvature of the morphological profile.

8. The method of claim 1, wherein selecting the number of the mattress modules comprises determining the number of occurrences for which a slope variation $\Delta S$ meets a threshold value.

9. The method of claim 1, further comprising selecting a length of a top surface of each mattress module in accordance with the slope variations in a longitudinal morphological profile.

10. The method of claim 1, wherein the mattress modules comprise two end mattress modules, and the method further comprises adjusting a length of at least one of the end mattress modules to meet mattress standard size specification.

11. The method of claim 1, wherein collecting data related to the pressure factors comprises manual measurement of a body shape of the mattress user.

12. The method of claim 1, wherein collecting data related to the pressure factors comprises 3D-scanning of the body of the mattress user.

13. The method of claim 1, wherein collecting data related to the pressure factors comprises determining a total height, an inside leg height, a hip height, an upper and lower waist height, an axilla height, an acromion height, a neck height and a distance between anatomic landmarks of the body of the mattress user.

14. The method of claim 1, wherein the pressure factors further comprise a sleep position.

15. The method of claim 1, wherein selecting the deformability of each one of the mattress modules comprises selecting a material for each mattress module with a given density and mechanical properties.

16. The method of claim 1, wherein the selection of the deformability for each mattress module is performed among a finite number of available deformabilities.

17. The method of claim 1, wherein the deformability profile that is selected results in the lowest optimisation factor.

18. The method of claim 17, wherein the optimisation factor is function of a rotation of the body in at least one of a sagittal plane or transverse plane.

19. The method of claim 17, wherein the optimisation factor is function of a force rendered by at least one mattress module upon being contacted with the mattress user.

20. A modular multi-zone mattress having an optimized sleep surface, the modular multi-zone mattress being made according to the method as defined in claim 1.

* * * * *